United States Patent [19]

Clay

[11] Patent Number: 4,494,718

[45] Date of Patent: Jan. 22, 1985

[54] NAPKIN HOLDER

[76] Inventor: Sylvia J. Clay, 956 S. 6th St., Louisville, Ky. 40203

[21] Appl. No.: 387,862

[22] Filed: Jun. 14, 1982

[51] Int. Cl.[3] ..... A45F 5/04

[52] U.S. Cl. ..... 248/1; 24/7; D7/72

[58] Field of Search ..... D7/72; 24/7, 256; 248/1, 127; 229/1.5 R; 285/156

[56] References Cited

U.S. PATENT DOCUMENTS

D. 19,461 12/1889 Locke ..... D7/72
D. 151,738 11/1948 Chernow .
4,153,279 5/1979 Blue ..... 285/156

FOREIGN PATENT DOCUMENTS 158956 6/1940 Fed. Rep. of Germany ... 248/DIG. 12

*Primary Examiner*—William H. Schultz
*Assistant Examiner*—Robert A. Olson
*Attorney, Agent, or Firm*—Maurice L. Miller, Jr.

[57] ABSTRACT

A napkin holder consisting of a mass of material such as glass, marble, ceramic, plastic, wood, metal or metal alloy or other suitable rigid material which contains two perpendicularly intersecting shafts, one of which extends through the mass and opens onto opposite surfaces of the mass and the other of which intersects the first shaft at a mid-point in the length thereof and extends upwardly to open on an upper surface of the mass is disclosed. A cloth napkin can be inserted through the shafts and can readily be arranged in a wide choice of attractive configurations.

12 Claims, 4 Drawing Figures

NAPKIN HOLDER

BACKGROUND OF THE INVENTION

This invention relates generally to napkin holders and specifically to napkin holders adapted to permit a cloth dinner napkin to be disposed or inserted therein in a wide number of different configurations as desired.

Examples of napkin rings known to the prior art include the hollow sphere having a tripartite truncation disclosed in U.S. Pat. No. 19,461 issued to J. Locke on Dec. 3, 1889 and the ornamental ring design shown in U.S. Pat. No. D-255,083 issued to G. P. Knott on May 27, 1980. Another such prior art napkin ring consisting of a cylindrical ring with nameplate thereon is disclosed in U.S. Pat. No. 3,965,591 issued to A. J. LeSueur on June 29, 1976. These rings, however, do not provide means for arranging cloth napkins therein in a wide variety of different configurations.

By means of my invention, this disadvantage of prior art napkin holders is substantially overcome.

SUMMARY OF THE INVENTION

It is an object of my invention to provide a novel napkin holder for a cloth dinner napkin which permits the napkin to be arranged in a wide variety of different configurations.

Briefly, in accordance with the object of my invention, I provide a napkin holder which includes a mass of material defining a first hollow shaft extending through and opening onto opposing surfaces of the mass. A second hollow shaft perpendicularly intersects the first shaft and opens onto an upper surface of the mass.

This and other objects, features and advantages of the present invention will become readily apparent to those skilled in the art from the following detailed description and attached drawing by way of which only the preferred embodiments of my invention are illustrated.

DESCRIPTION OF THE PREFERRED EMBODIMENTS

Figure 2:
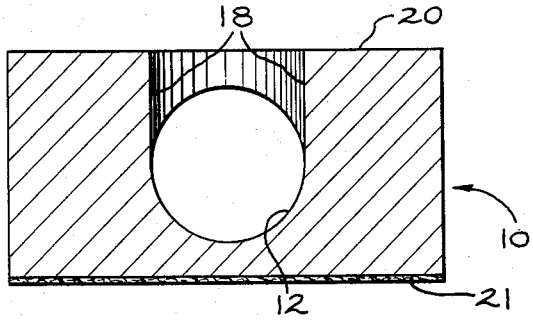
FIG. 2 shows a cross-sectional elevation view of the napkin holder of FIG. 1 as viewed along cross-section lines 2—2 of the latter figure.
Figure 3:
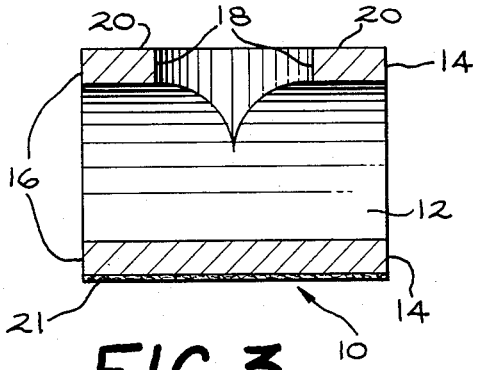
FIG. 3 shows another cross-sectional elevation view of the napkin holder of FIG. 1 as viewed along cross-section lines 3—3 of the latter figure.
Figure 1:
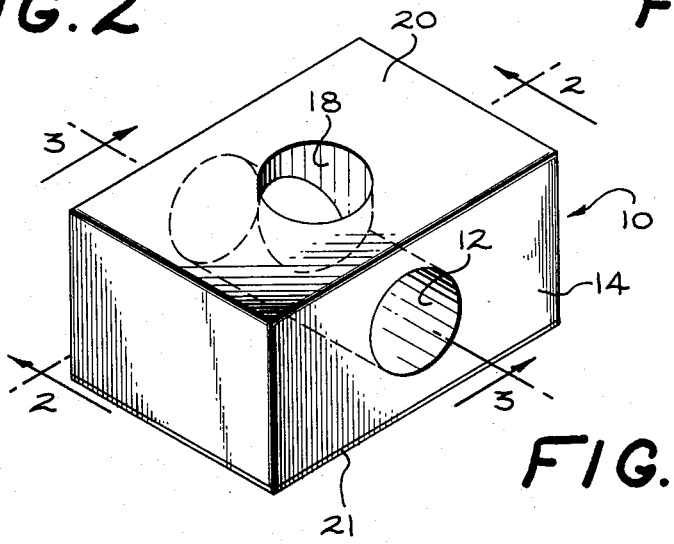
FIG. 1 shows an oblique view of a napkin holder thus illustrating one preferred embodiment of my invention.

Referring now to FIGS. 1–3, there is shown, in one preferred embodiment of my invention, a napkin holder 10 which may be constructed of any suitable mass of material such as wood, marble, glass, ceramic, plastic, metal or metal alloy, to name but a few. The holder 10 is formed in the shape of a rectangular parallelepiped. A first hollow cylindrically shaped shaft 12 extends between and opens onto opposite faces 14 and 16 of the holder 10. A second hollow cylindrically shaped shaft 18, having a diameter approximately equal to the diameter of the shaft 12, opens on an upper surface 20 and extends downwardly to perpendicularly intersect and communicate with the shaft 12 at a mid-point in the length of the latter. A layer 21 of felt or similar material may be applied to the base of the holder 10 when used on tables to avoid scratching of the table surface.

Figure 4:
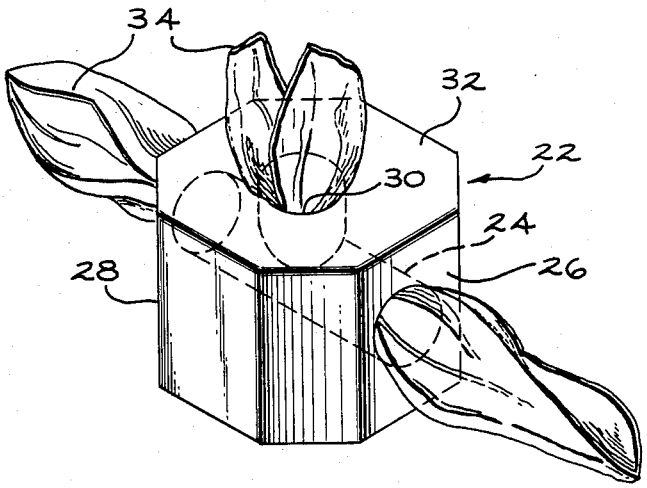
FIG. 4 shows an oblique view of a napkin holder containing a napkin thus illustrating another preferred embodiment of my invention.

Referring now to FIG. 4, a napkin holder 22 is shown which is in the form of an octagonal parallelepiped thus illustrating another preferred embodiment of my invention. As in the prior example, the holder 22 defines a hollow cylindrically shaped shaft 24 which extends between and opens onto opposing faces 26, 28 which is perpendicularly intersected along a midportion of the length thereof by a vertically extending hollow cylindrically shaped shaft 30 which, in turn, opens onto an upper surface 32. FIG. 4 is illustrative of but one of many attractive arrangements for a dinner napkin 34 which may be formed by insertion of the latter through the interconnecting shafts 24 and 30. I have found that the interconnecting shafts of the napkin holder of my invention as shown, permit a cloth dinner napkin to be arranged therein in a large variety of configurations, not heretofore possible using conventional napkin holders. Also, a wide variety of different geometric forms can be employed for the mass defining the intersecting shafts.

Although the present invention has been shown and described herein with reference to specific details of certain preferred embodiments thereof, it is not intended that such details limit the scope of the present invention otherwise than as set forth in the following claims.

What I claim as new and desire to secure by Letters Patent of the United States is:

1. In combination with a napkin, a napkin holder comprising a mass of material defining a first hollow shaft extending through and opening onto opposing, parallel, planar, vertically extending surfaces of said mass and a second hollow shaft perpendicularly intersecting said first shaft and extending vertically upward and opening onto an upper planar surface of said mass, said napkin extending through said shafts with a portion of said napkin extending outside of each opening of each shaft beyond the exterior surfaces of said mass to form an ornamental napkin display.

2. The holder of claim 1 wherein said shafts are cylindrically shaped.

3. The holder of claim 1 wherein said second shaft intersects said first shaft on a mid-portion of the length thereof.

4. The holder of claim 1 wherein the diameter of said first and second shafts are substantially equal.

5. The holder of claim 1 wherein said mass is constructed of glass.

6. The holder of claim 1 wherein said mass is constructed of marble.

7. The holder of claim 1 wherein said mass is constructed of ceramic.

8. The holder of claim 1 wherein said mass is constructed of plastic.

9. The holder of claim 1 wherein said mass is constructed of wood.

10. The holder of claim 1 wherein said mass is constructed of metal.

11. The holder of claim 1 wherein said mass is constructed in the form of a rectangular parallelepiped.

12. The holder of claim 1 wherein said mass is constructed in the form of an octagonal parallelepiped.

* * * * *